US011203478B2

(12) United States Patent
Wei

(10) Patent No.: US 11,203,478 B2
(45) Date of Patent: Dec. 21, 2021

(54) CONTAINER COVER AND VACUUM PRESERVATION CONTAINER

(71) Applicant: THANKHOT BIOTECHNOLOGY CO., LTD., Zhuhai (CN)

(72) Inventor: Honghua Wei, Guangdong (CN)

(73) Assignee: THANKHOT BIOTECHNOLOGY CO., LTD., Zhuhai (CN)

( * ) Notice: Subject to any disclaimer, the term of this patent is extended or adjusted under 35 U.S.C. 154(b) by 12 days.

(21) Appl. No.: 16/958,214

(22) PCT Filed: Feb. 1, 2018

(86) PCT No.: PCT/CN2018/074895

§ 371 (c)(1),
(2) Date: Jun. 26, 2020

(87) PCT Pub. No.: WO2019/127835

PCT Pub. Date: Jul. 4, 2019

(65) Prior Publication Data

US 2021/0070524 A1 Mar. 11, 2021

(30) Foreign Application Priority Data

Dec. 29, 2017 (CN) ..... 201711483335.3

(51) Int. Cl.
*B65D 81/20* (2006.01)
*B65D 53/02* (2006.01)
*B65D 51/16* (2006.01)

(52) U.S. Cl.
CPC ..... *B65D 81/2038* (2013.01); *B65D 51/1683* (2013.01); *B65D 53/02* (2013.01); *B65D 51/1644* (2013.01); *B65D 2543/00972* (2013.01)

(58) Field of Classification Search
CPC . B65D 81/2038; B65D 53/02; B65D 51/1644
See application file for complete search history.

(56) References Cited

U.S. PATENT DOCUMENTS 5,277,326 A * 1/1994 Chiba ..... A47J 27/002 220/231
5,558,243 A * 9/1996 Chu ..... B65D 81/2038 215/228

(Continued)

FOREIGN PATENT DOCUMENTS

CN 201525559 U 7/2010
CN 102730300 A 10/2012

(Continued)

OTHER PUBLICATIONS

English Translation of International Search Report dated Aug. 30, 2018, in connection with Chinese Patent Application No. PCT/CN2018/074895.

(Continued)

*Primary Examiner* — John K Fristoe, Jr.
*Assistant Examiner* — Eric C Baldrighi
(74) *Attorney, Agent, or Firm* — Norris McLaughlin, P.A.

(57) ABSTRACT

Disclosed are a container cover and a vacuum preservation container. The container cover comprises a cover body and an air extraction assembly, wherein a first through hole is provided in the cover body, the air extraction assembly comprises an outer cover and an inner cover, the inner cover is arranged on an upper end of the first through hole in a sealing manner, a second through hole and a third through hole are provided in the inner cover, the second through hole is in communication with the first through hole, a first one-way valve is arranged in the second through hole, and a second one-way valve is arranged in the third through hole.

20 Claims, 6 Drawing Sheets

(56) References Cited

U.S. PATENT DOCUMENTS

| | | | | | |
|---|---|---|---|---|---|
| 5,692,632 | A * | 12/1997 | Hsieh | B65D 81/20 | 215/228 |
| 6,644,489 | B2 * | 11/2003 | Chang | B65D 81/2038 | 215/260 |
| 2020/0148447 | A1 | 5/2020 | Wei | | |

FOREIGN PATENT DOCUMENTS

| | | | |
|---|---|---|---|
| CN | 205366586 | U | 7/2016 |
| CN | 205916561 | U | 2/2017 |
| CN | 106865017 | A | 6/2017 |
| CN | 107031976 | A | 8/2017 |

OTHER PUBLICATIONS

International Search Report dated Aug. 30, 2018, in connection with Chinese Patent Application No. PCT/CN2018/074895.
Written Opinion and English Translation dated Sep. 27, 2018, in connection with Chinese Patent Application No. PCT/CN2018/074895.

* cited by examiner

CONTAINER COVER AND VACUUM PRESERVATION CONTAINER

This application is the U.S. National Stage of International Application No. PCT/CN2018/074895, filed Feb. 1, 2018, which claims foreign priority benefit under 35 U.S.C. § 119 of Chinese Application No. 201711483335.3, filed Dec. 29, 2017.

TECHNICAL FIELD

The invention relates to the field of vacuum equipment, in particular to a container cover for vacuum pumping and a vacuum preservation container with the container cover. The invention is based on a Chinese patent which was filed on Dec. 29, 2017 and the application number of which is CN201711483335.3. The content of the Chinese patent is hereby incorporated by reference.

BACKGROUND

Container is a common daily necessities, the common containers comprise preservation tanks, preservation boxes, preservation cases, preservation cups, and preservation bottles and so on. A container generally comprises container body and container cover. After putting food, medicine and the like into the container body and covering the container cover, the container can well isolate the articles placed in the container body and prevent dust, air and the like from entering into the container body. The existing container can achieve good sealing and prevent the air from entering, so that it plays a certain role in the preservation of articles. But the container body itself has a certain amount of air, so that it is impossible to ensure that the articles in the container body are in a vacuum state and the preservation period is short.

A Chinese patent CN107031976A discloses a vacuum cover for preservation tanks, which comprises a cover body on which a cavity is arranged, a vacuuming pressing block arranged on the cavity by means of a first reset spring, a sliding seal fit between the edge of the pressing block of vacuum pumping and the inner wall of the cavity, and a food grade lubricant filled in the place of the sliding seal fit. The pressing block of vacuum pumping is composed of the outer handle and the inner handle, and a positioning slot is formed at the position where the outer handle is interlocked with the inner handle. A sealing ring is arranged in the positioning slot, the outer edge of the sealing ring is fitted and sealed with the inner wall of the cavity, and there is a gap between the inner edge of the sealing ring and the bottom of the positioning slot. When the pressing block of vacuum pumping is pressed, the sealing ring is located in the positioning slot and close to the upper edge of the positioning slot, at which time the air in the vacuum cavity is discharged from the exhaust port. When the pressing block of vacuum pumping is released, the first reset spring pushes the pressing block of vacuum pumping upward, the sealing ring is located in the positioning slot and near the lower edge of the positioning slot, the exhaust port is closed, at this time the one-way valve is opened, the air in the preservation tank is pumped into the vacuum pumping cavity. When the pressing block of vacuum pumping is pressed again, the one-way valve is closed, the exhaust port is opened, the air in the vacuum pumping cavity is discharged, and the pressing block of pumping vacuum is pressed circularly. Finally, the vacuum pumping cavity and the inner cavity of the preservation tank are in a vacuum state.

The preservation time of the articles is prolonged by vacuum pumping for the preservation tank via the above vacuum cover and keeping a vacuum environment in the tank. But the structure of the pressing block of vacuum pumping is complex, and the cost of production and assembly is high, which increases the overall cost of preservation tank. It is necessary to add lubricant between the edge of the pressing block of vacuum pumping and the inner wall of the cavity. The lubricant will have some loss during use, which will affect the smoothness of the fit between the pressing block of vacuum pumping and the cavity; when the liquid is preserved in the tank, the lubricant may also cause pollution to the liquid; after the vacuum cover is used, it needs to be cleaned, and the lubricant in the cover body will affect the cleaning effect, even that the user would mistake for the lubricant is the oil stain in the cover.

SUMMARY

The main purpose of the invention is to provide a container cover with simple structure and without using lubricant.

Another purpose of the invention is to provide a vacuum preservation container with the above container cover.

Technical Solutions

In order to realize the above main purpose, the container cover provided by the invention comprises a cover body, a first through hole is provided at the upper surface of the cover body, the first through hole is provided with air extraction assembly, the air extraction assembly comprises an outer cover and an inner cover, the inner cover is arranged on an upper end of the first through hole in a sealing manner, a second through hole and a third through hole are provided at the upper surface of the inner cover, the second through hole is in communication with a first through hole, the second through hole is provided with a first one-way valve, and the third through hole is provided with a second one-way valve; the outer cover is made of elastic material and has an arch-shaped first top wall, the outer cover is arranged hermetically at the upper end of the inner cover, an air extraction cavity is enclosed between the outer cover and the inner cover. The first top wall constitutes the top wall of the air extraction cavity, the first through hole and the second through hole are located at the bottom of the air extraction cavity. The air flow direction of the first one-way valve is from outside of the air extraction cavity to inside of the air extraction cavity, and the air flow direction of the second one-way valve is from inside of the air extraction cavity to outside of the air extraction cavity.

According to a specific technical scheme, the outer cover also has an annular first side wall, the first side wall is located on the outer edge of the first top wall, the inner cover comprises a circular second top wall and a annular second side wall, the second through hole and the third through hole are both located on the second top wall, and the second side wall is located on the outer edge of the second top wall; the outer cover is arranged on the inner cover, and there is interference fit between the first side wall and the second side wall.

According to another specific technical scheme, a first step portion is provided at the inner circumference wall of the outer cover at the joint of the first top wall and the first side wall, and the outer edge of the second top wall is attached to the first step portion.

According to another specific technical scheme, the upper surface of the cover body is provided with a first concave portion, the first through hole is located inside the first concave portion, a first annular convex is arranged outside the first through hole, the lower surface of the second top wall is attached to the first annular convex, the first through hole and the second through hole are both located inside the axial extension area of the first annular convex, and the third through hole is located outside the axial extension area of the first annular convex.

According to another specific technical scheme, the first concave portion is further provided with a second annular convex, the first annular convex is located in the area surrounded by the second annular convex, the third through hole is located between the first annular convex and the second annular convex, the second annular convex is provided with a first notch, a annular mounting groove is formed between the second annular convex and the circumferential wall of the first concave portion, the first side wall and the second side wall are located within the mounting groove, the first side wall is provided with a second notch, and the first notch and second notch are in communication with each other.

According to another specific technical scheme, the second top wall is provided with a second concave portion, the second through hole is located in the second concave portion, the third through hole is located outside the second concave portion, the second concave portion is provided with a second step portion, the second step portion is provided with an air valve seat, the first one-way valve is arranged on the air valve seat, the air valve seat is provided with a fixing ring, and there is interference fit between the fixing ring and the second concave portion.

According to another specific technical scheme, the second top wall is also provided with a third concave portion, the third concave portion is adjacent to the second concave portion, the third concave portion is provided with a third annular convex, and the third through hole is located in the area surrounded by the third annular convex.

According to another specific technical scheme, a reset spring is arranged in the air extraction cavity, one end of the reset spring is attached to the first top wall, and the other end of the reset spring is attached to the inner cover.

According to another specific technical scheme, the cover body is also provided with a fourth through hole, the fourth through hole is located on the outside of the air extraction assembly, and the fourth through hole is provided with a sealing plug.

In order to achieve another purpose, the vacuum preservation container provided by the invention comprises a body and a container cover arranged at the opening end of the body, the container cover adopts the above container cover, and the air flow direction of the first one-way valve is from the inside of the body to the inside of the air extraction cavity.

Technical Effects

After the container cover of the invention is covered on the container body, the volume of the air extraction cavity becomes smaller and the intensity of pressure in the air extraction cavity increases by pressing the elastic first top wall on the air extraction cavity. The air flow direction of the first one-way valve is from the container body outside the air extraction cavity to the air extraction cavity, and the air flow direction of the second one-way valve is from inside of air extraction cavity to outside of the air extraction cavity, thus the air in the air extraction cavity can not enter the container body through the first one-way valve, and can only be discharged to the external environment through the second one-way valve. During the top wall performs springback, the volume of the air extraction cavity increases and the intensity of pressure in the air extraction cavity becomes smaller, the air in the external environment can not enter the air extraction cavity through the second one-way valve, and the air in the container body enters the air extraction cavity through the first one-way valve until the intensity of pressure in the air extraction cavity is equal to the intensity of pressure in the container body. Pressing the top wall repeatedly, each time press the top wall of the air extraction cavity can draw part of the air from the body of the container, finally the air in the container body is almost exhausted and the interior of the container body is maintained as a vacuum environment, the preservation period of the article is improved. The container cover according to the invention has a simple structure, it doesn't need to add lubricant inside the container cover. The outer cover and the inner cover can be directly removed from the cover body, and the first one-way valve and the second one-way valve are both arranged on the inner cover, so it is very convenient to clean the cover body.

The invention is further explained in conjunction with the drawings and embodiments below.

DETAILED DESCRIPTION OF THE EMBODIMENTS

Figure 1:
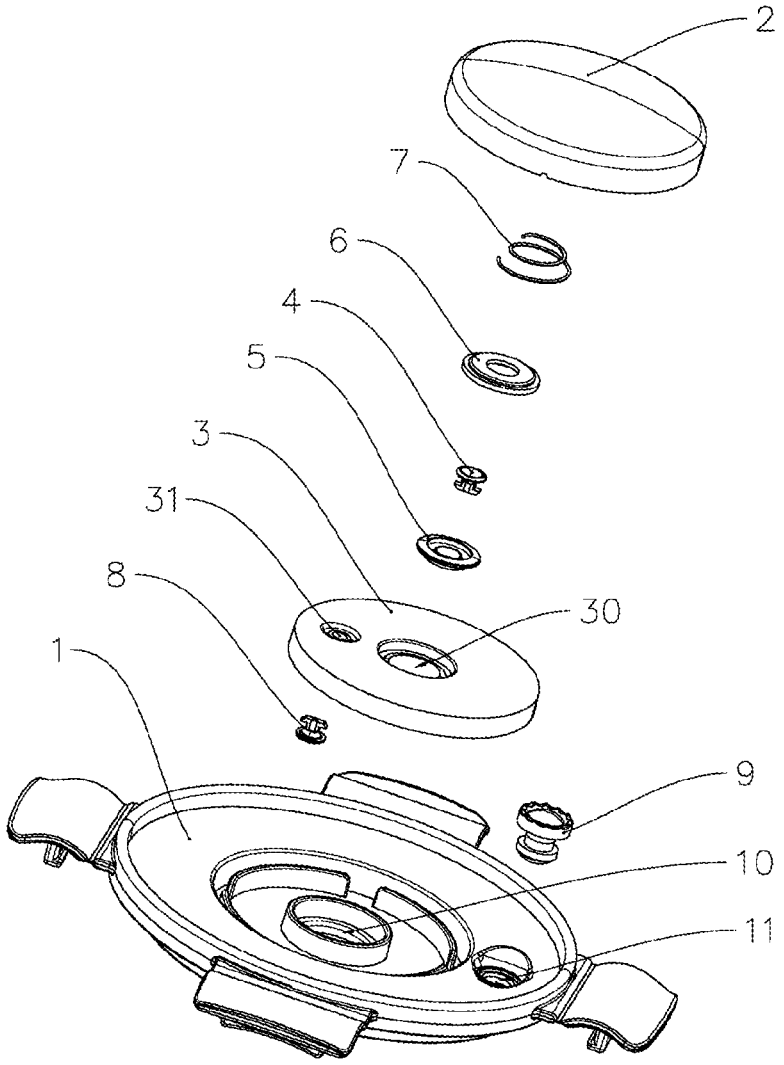
FIG. 1 is a structural exploded view of the container cover according to an embodiment of the present invention.

Referring to FIG. 1, FIG. 1 is a structural decomposition diagram of the container cover according to an embodiment of the present invention. The container cover comprises a cover body 1 and an air extraction assembly. The air extraction assembly comprises an outer cover 2 and an inner cover 3, a first through hole 10 is provided throughout the upper surface, and the inner cover 3 is hermetically arranged at the upper end of the first through hole 10. A second through hole 30 and a third through hole 31 is provided throughout the upper surface of the inner cover 3, the second through hole 30 is in communication with the first through hole 10. The first one-way valve 4 is mounted in the second through hole 30 by means of the air valve seat 5 and the fixing ring 6, and a reset spring 7 is arranged between the fixing ring 6 and the outer cover 2, and a second one-way valve 8 is arranged on the third through hole 31. The cover body 1 is also provided with a fourth through hole 11, the fourth through hole 11 is located on the outside of the air extraction assembly, and the fourth through hole 11 is provided with a sealing plug 9.

Figure 2:
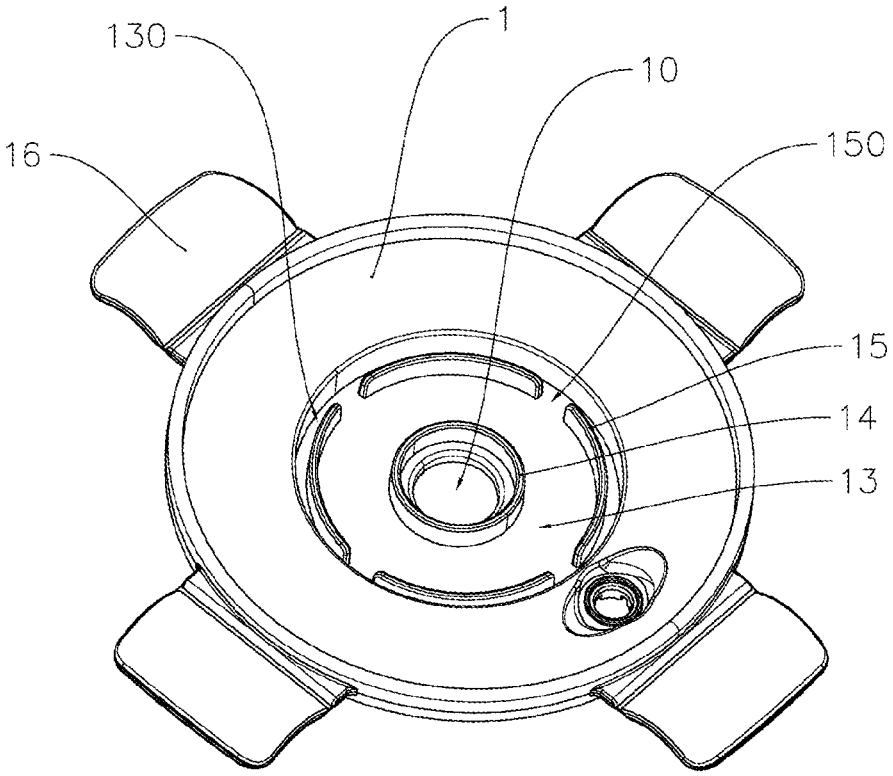
FIG. 2 is a structure diagram of the cover body of the container cover according to an embodiment of the present invention.

Referring to FIG. 2, FIG. 2 is a structure diagram of the cover body of the container cover according to an embodiment of the present invention. In the embodiment, the cover body 1 is made of plastic material (e.g. polypropylene) and has a disc-shaped structure. In other embodiments, the cover body 1 may also be other shapes, such as square, oval, etc. A first concave portion 13 is provided at the middle part of the upper surface of the cover body 1, and the first through hole 10 is located in the middle of the first concave portion 13. The first annual convex 14 and the second annual convex 15 are arranged within the first concave portion 13 in turn from the first through hole 10 to the outside. The first through hole 10, the first annual convex 14 and the second annual convex 15 are coaxially arranged. Both the first through hole 10 and the second through hole 30 (see FIG. 1) are located in the axial extension area of the first annual convex 14, and the third through hole 31 (see FIG. 1) is located between the first annual convex 14 and the second annual convex 15. A first notch 150 is provided throughout the second annual convex 15, an annual mounting groove 130 is formed between the second ring bulge 15 and the circumferential wall of the first concave portion 13. The side wall of the outer cover 2 and the side wall of the inner cover 3 are located within the mounting groove 130. The outer edge of the cover body 1 is evenly arranged with four lock catches 16.

Figure 3:
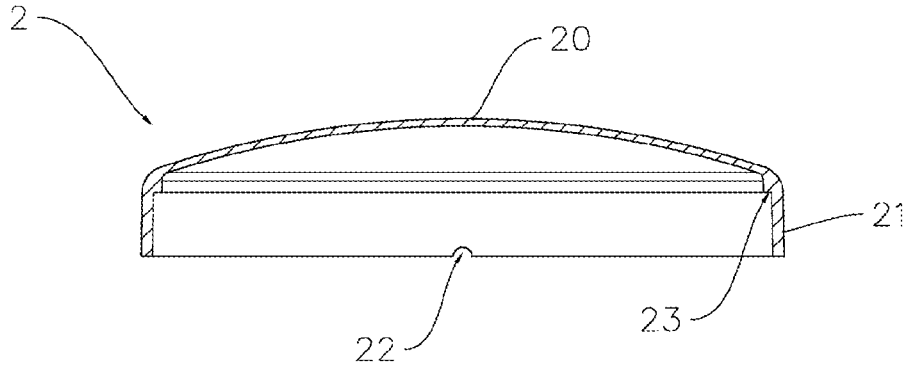
FIG. 3 is a sectional view of the outer cover of the container cover according to an embodiment of the present invention.

Referring to FIG. 3, FIG. 3 is a sectional view of the outer cover of the container cover according to an embodiment of the present invention. The outer cover 2 is made of elastic material. In the embodiment, the outer cover 2 is made of polypropylene material in one piece. The outer cover 2 comprises an arch-shaped first top wall 20 and an annular first side wall 21. A second notch 22 is provided throughout the first side wall 21, the second notch 22 and the first notch 150 (see FIG. 2) are in communication with each other. A first step portion is provided at the inner circumference wall of the outer cover 2 at the joint of the first top wall and the first side wall.

Figure 4:
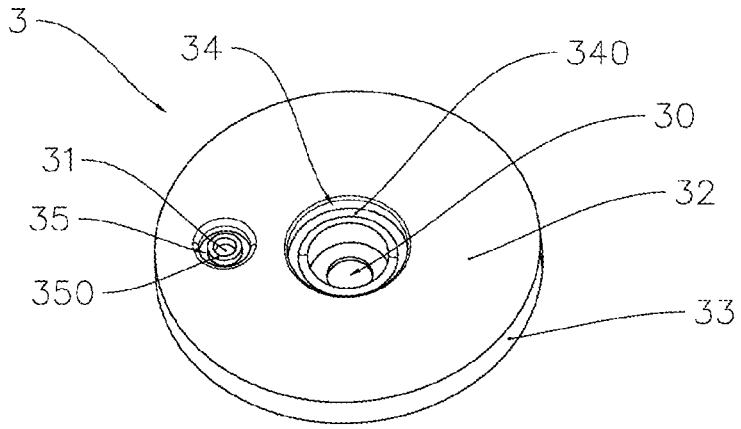
FIG. 4 is a structure diagram of the inner cover of the container cover according to an embodiment of the present invention.

Referring to FIG. 4, FIG. 4 is a structure diagram of the inner cover of the container cover according to an embodiment of the present invention. In the present embodiment, the inner cover 3 comprises a circular second top wall 32 and a circular second side wall 33, the outer edge of the second top wall 32 is attached to the first step portion 23. a second concave portion 34 and a third concave portion 35 are provided at the upper surface of the second top wall 32, the second concave portion 34 is located in the middle of the second top wall 32, the third concave portion 35 is located on the outside of the second concave portion 34, and the second through hole 30 is located within the second concave portion 34. The second concave portion 34 is provided with a second step portion 340, the air valve seat 5 is arranged on the second stage 340, and there is interference fit between the fixing ring 6 and the second concave portion 34. A third annual convex 350 is arranged in the third concave portion 35, and the third through hole 31 is located within the area surrounded by the third annual convex 350.

Figure 5:
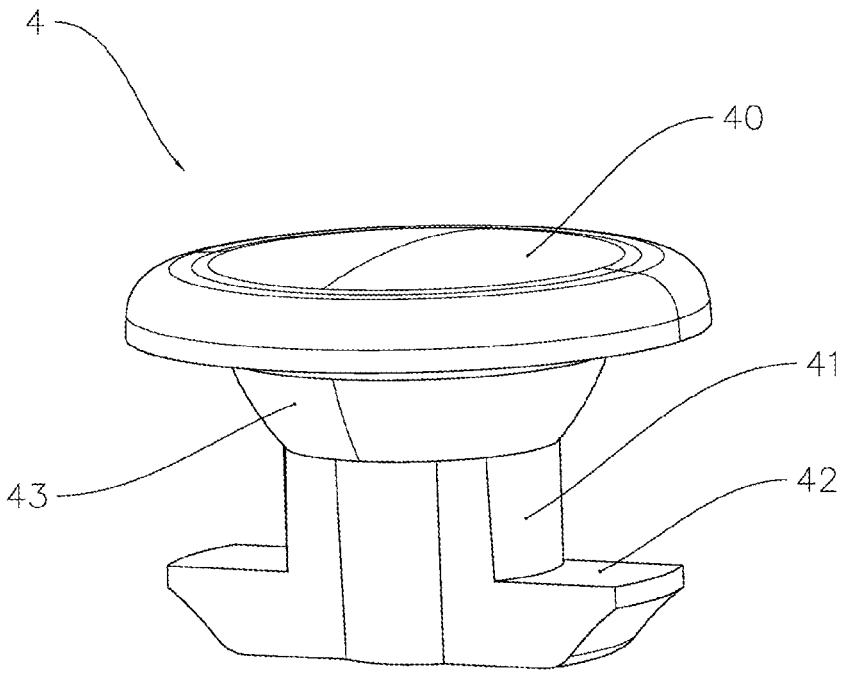
FIG. 5 is a structure diagram of the first one-way valve of the container cover according to an embodiment of the present invention.

Referring to FIG. 5, FIG. 5 is a structure diagram of the first one-way valve of the container cover according to an embodiment of the present invention. In the embodiment, the first one-way valve 4 is made of silica gel material in one piece, the first one-way valve 4 comprises a circular plug body portion 40 and a square connecting portion 41. The square connecting portion 41 is arranged at the lower end of the plug body portion 40, and a protruding stuck portion 42 is provided at the outer wall of the connecting portion 41. The joint between the plug body portion 40 and the connecting portion 41 is provided with a faying portion 43 having a radial size gradually reduced from top to bottom and a smooth surface. The structure of the second one-way valve 8 is the same as that of the first one-way valve 4. The second one-way valve 8 also comprises a plug body portion and a stuck portion, the mounting direction of the second one-way valve 8 is opposite to the mounting direction of the first one-way valve 4. The stuck portion of the second one-way valve 8 is attached to the upper end of the third ring bulge 350 (see FIG. 4).

Figure 6:
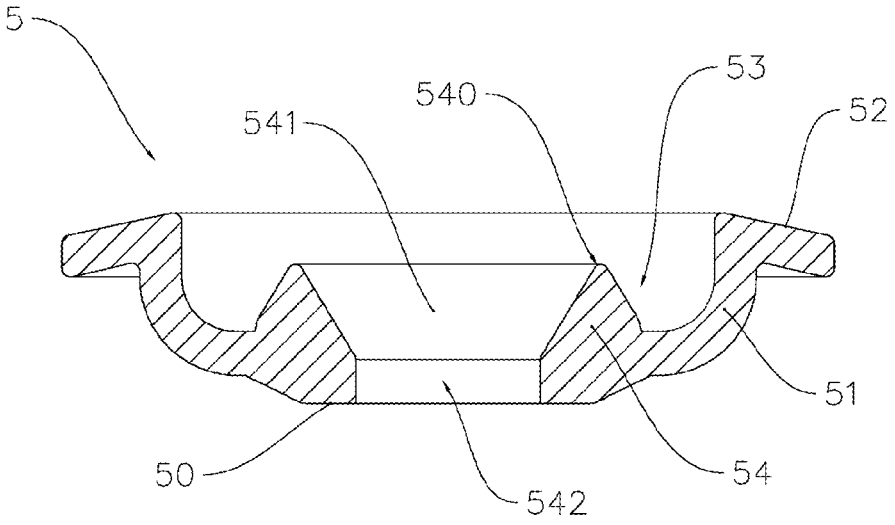
FIG. 6 is a sectional view of the air valve seat of the container cover according to an embodiment of the present invention.

Referring to FIG. 6, FIG. 6 is a sectional view of the air valve seat of the container cover according to an embodiment of the present invention. In the embodiment, the air valve seat 5 comprises a annual third side wall 51, a third top wall 52 extending outward is provided at the upper end outer edge of the third side wall 51, and the third top wall 52 is attached to the second step portion 340 (see FIG. 4). The third side wall 51 forms a fourth concave portion 53, the fourth concave portion 53 has an upward opening and is provided with a mounting seat 54. The upper end of the mounting seat 54 is provided with an inverted cone-shaped annual seal portion 540, the inner circumference of the annual seal portion 540 forms a smooth faying surface 541, the radial dimension of the faying surface 541 is gradually reduced from top to bottom. A fifth through hole 542 is provided throughout the middle of the mounting seat 54 and throughout the annual seal portion 540. The first one-way valve 4 is mounted on the fifth through hole 542, the plug body portion 40 is attached to the upper end of the annual seal portion 540, and the faying portion 43 is located on the faying surface 541. The connecting portion 41 passes through the fifth through hole 542, and the clamping portion 42 is attached to the bottom wall 50 of the air valve seat 5.

Figure 7:
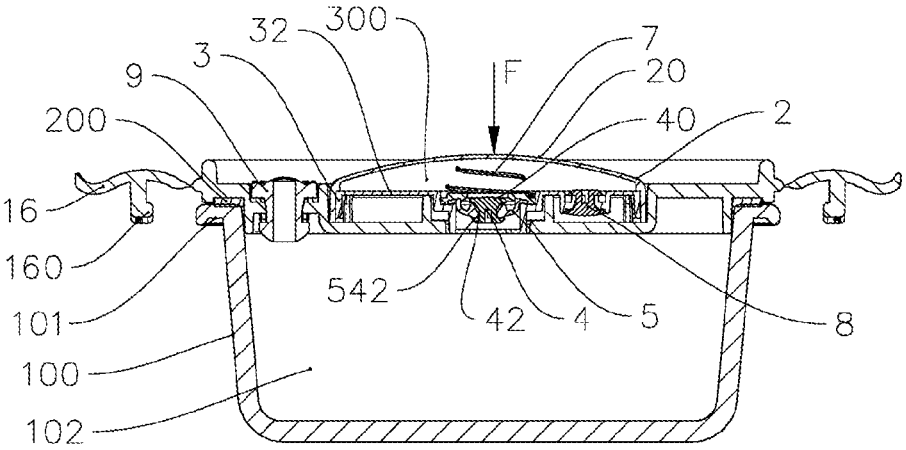
FIG. 7 is a sectional view of the vacuum preservation container according to an embodiment of the present invention.

Referring to FIG. 7, FIG. 7 is a sectional view of the vacuum preservation container according to an embodiment of the present invention. The vacuum preservation container comprises a body 100 and a container cover arranged at the opening end of the body 100, and a sealing ring 200 is arranged between the body 100 and the container cover. In the embodiment, the body 100 is a cylindrical tank body. The body 100 can be made of materials such as glass, metal or plastic, the shape of the body 100 can be redesigned as needed. For example, the body 100 can also be designed as oval, square, etc. The container cover in the above embodiment is applied, and the assembled container covers on the body 100. When moving the lock catch 16 on the cover body 1 and locking the retaining member 160 of the lock catch 16 on the hook portion 101 of the body 100, it is sealed between the body 100 and the cover body 1 by means of the sealing ring 200. A sealed air extraction cavity 300 is formed between the first top wall 20 of the outer cover 2 and the second top wall 32 of the inner cover 3, and the first top wall 20 constitutes the top wall of the air extraction cavity 300. The reset spring 7 is located in the air extraction cavity 300. Because the outer cover 2 has elasticity and the first top wall 20 can performs springback automatically after being pressed, in other embodiments the reset spring 7 can also be canceled.

Referring to FIGS. 1-6, when pressing the first top wall 20 along the force F in FIG. 7, the first top wall 20 is deformed due to the first top wall 20 is elastic. The volume of the air extraction cavity 300 becomes smaller and the intensity of pressure in the air extraction cavity 300 increases, and the intensity of pressure in the air extraction cavity 300 is greater than the intensity of pressure in the inner cavity 102 of the body 100. Thus the air in the air extraction cavity 300 exerts a downward pressure on the first one-way valve 4, so that the plug 40 on the first one-way valve 4 is close to the upper end of the annular seal 540 of the valve seat 5, and thus the fifth through hole 542 on the valve seat 5 is closed, the air within the air extraction cavity 300 can not enter the inner cavity 102 through the fifth through hole 542. At the same time, because the intensity of pressure in the air extraction cavity 300 is greater than the intensity of external pressure, the air in the air extraction cavity 300 exerts a downward thrust on the second one-way valve 8, which causes the plug portion on the second one-way valve 8 to separate from the lower surface of the third one-way valve 31, the third one-way valve 31 is in an open state, the air in the air extraction cavity 300 passes through the third through hole 31 (see FIG. 4), the first notch 150 (see FIG. 2) and the second notch 22 (see FIG. 3) in turn to the external environment.

When the first top wall 20 deforms to a certain extent, removing the force F, then the first top wall 20 performs springback under the action of its self-elasticity and the elastic force of the reset spring 7. The volume of the air extraction cavity 300 increases and the intensity of pressure in the air extraction cavity 300 becomes smaller. At this time, the intensity of external pressure is greater than the intensity of pressure in the air extraction cavity 300, and the external air exerts a upward thrust on the second one-way valve 8, so that the plug body portion on the second one-way valve 8 is close to the lower surface of the third through hole 31 the third through hole 31 is closed. At the same time, the intensity of pressure in the inner cavity 102 of the body 100 is also greater than the intensity of pressure in the suction cavity 300. The air in the cavity 102 exerts upward thrust on the first one-way valve 4, so that the plug body portion 40 of the first one-way valve 23 is separated from the annular seal 540 of the valve seat 5. The fifth hole 542 on the valve seat 5 is opened, the air in the cavity 102 passes through the fifth hole 542 into the air extraction cavity 300, until the intensity of pressure in the air extraction cavity 300 is equal to the intensity of pressure in the cavity 102. When the first top wall 20 returns to its original state, the air in the cavity 102 is partly drawn out to the air extraction cavity 300. Then a force F is applied again and the above steps repeat. After repeated pressing, the air in the inner cavity 103 is almost exhausted, and the body 100 is almost in a vacuum environment which is beneficial to the preservation of the articles placed in the body 100, and the preservation period of the articles is prolonged. When it is necessary to open the container cover, the sealing plug 9 is moved on the fourth through hole 11 for a certain gap. The air passes through the fourth through hole 11 into the inner cavity 102, the vacuum environment within the body 100 is released, which makes the container cover easy to open from the body 100.

It can be seen that the air flow direction of the first one-way valve 4 is from the inner cavity 102 to the inside of the air extraction cavity 300 (that is, flowing from outside of the air extraction cavity to inside of the air extraction cavity), the flow direction of the second one-way valve 8 is from the inside of the self-extraction cavity 300 to the external environment (that is, flowing from inside of the air extraction cavity to outside of the air extraction cavity). The flow direction of air at the first one-way valve 4 is one-way. The air flows only from the inner cavity 102 into the air extraction cavity 300 and can not enter the inner cavity 102 from the air extraction cavity 300. The flow direction of air at the second one-way valve 8 is also one-way. The air flows only from the air extraction cavity 300 into the external environment, but can not enter the air extraction cavity 300 from the external environment.

The container cover of the invention has the following advantages: simple structure, low assembly and production cost, easy disassembly, no need to add lubrication and the outer cover and the inner cover can be removed directly from the top of the cover body. While the first one-way valve and the second one-way valve are both arranged on the inner cover, the cover body is very convenient to be cleaned after removing the outer cover and the inner cover from the cover body.

The above embodiments are only better embodiments of the invention, and many changes may be made in practical application, for example, a simple change in the size and shape of the vacuum preservation container; or a change in the material of the container cover; or a change in the shapes of the outer cover and the inner cover which may not be necessarily circular, they may be square, oval, etc. These changes can also achieve the purpose of the invention, and any modification, equivalent substitution, improvement, etc. made within the spirit and principles of the invention shall be included in the protection scope of the claim of the invention.

INDUSTRIAL APPLICATIONS

The container cover of the invention can be applied to a wide-mouth container for sealing. The air in the air extraction cavity above the container cover is discharged by pressing the first top wall of the outer cover. At this time, the first one-way valve is closed, the second one-way valve is opened and the air in the air extraction cavity is discharged from the second one-way valve to the external environment; then the first top wall performs a springback under the action of its self-elasticity and the elastic force of the reset spring, the intensity of pressure in the suction cavity becomes smaller, the first one-way valve is opened, the second one-way valve is closed, and the air in the vessel enters the suction cavity from the first one-way valve. Repeat the above process, can exhaust the air in the container, the container is in a vacuum environment, the object stored in the container is isolated from the air, greatly improve the storage time of the object, especially for the storage of food, medicine, etc. When the container needs to be opened, the seal plug is opened by pulling the seal plug on the cover body, so that the seal plug is opened, the air enters the container from the seal plug, and the vacuum in the container is released, so that the container cover can be easily opened, so that the damage of the container cover or container caused by the excessive force of opening the container cover in the vacuum environment of the container can be prevented. The structure of the seal plug is simple, the manufacturing cost is low, and the installation and replacement are very convenient. The container cover according to the invention has a simple structure, it doesn't need to add lubricant inside the container cover. The outer cover and the inner cover can be directly removed from the cover body, and the first one-way valve and the second one-way valve are both arranged on the inner cover, so it is very convenient to clean the cover body.

The vacuum preservation container of the invention can be used as a preservation container for food, medicine, etc. The container cover is directly covered above the container, the locking seal is carried out by means of the lock catch and the sealing ring, the inside of the container is pumped to vacuum by means of the container cover, thus the preservation period of food, medicine and so on is prolonged.

The invention claimed is:

1. A container cover, comprising a cover body, wherein, a first through hole is provided at an upper surface of the cover body, the first through hole is provided with an air extraction assembly, the air extraction assembly comprises an outer cover and an inner cover, the inner cover is arranged on an upper end of the first through hole in a sealing manner, a second through hole and a third through hole are provided at an upper surface of the inner cover, the second through hole is in communication with the first through hole, the second through hole is provided with a first one-way valve, and the third through hole is provided with a second one-way valve;

the outer cover is made of elastic material and has a dome-shaped first top wall, the outer cover is arranged hermetically at an upper end of the inner cover, an air extraction cavity is enclosed between the outer cover and the inner cover, the first top wall constitutes a top wall of the air extraction cavity, the first through hole and the second through hole are located at a bottom of the air extraction cavity, an air flow direction of the first one-way valve is from outside of the air extraction cavity to inside of the air extraction cavity, and an air flow direction of the second one-way valve is from inside of the air extraction cavity to outside of the air extraction cavity.

2. The container cover of claim 1, wherein, the outer cover has an annular first side wall, the first side wall is located on an outer edge of the first top wall, the inner cover comprises a circular second top wall and a annular second side wall, the second through hole and the third through hole are both located on the second top wall, and the second side wall is located on an outer edge of the second top wall; the outer cover is arranged on the inner cover, and there is interference fit between the first side wall and the second side wall.

3. The container cover of claim 2, wherein, a first step is provided at an inner circumference wall of the outer cover at a joint of the first top wall and the first side wall, and the outer edge of the second top wall is attached to the first step.

4. The container cover of claim 3, wherein, a first concave portion is provided at the upper surface of the cover body, the first through hole is located inside the first concave portion, a first annular convex is arranged outside the first through hole, a lower surface of the second top wall is attached to the first annular convex, the first through hole and the second through hole are both located inside an axial extension area of the first annular convex, and the third through hole is located outside the axial extension area of the first annular convex.

5. The container cover of claim 4, wherein, the first concave portion is also provided with a second annular convex, the first annular convex is located in an area surrounded by the second annular convex, the third through hole is located between the first annular convex and the second annular convex, the second annular convex is provided with a first notch, a annular mounting groove is formed between the second annular convex and a circumferential wall of the first concave portion, the first side wall and the second side wall are located within the mounting groove, the first side wall is provided with a second notch, and the first notch and second notch are in communication with each other.

6. The container cover of claim 5, wherein, the second top wall is provided with a second concave portion, the second through hole is located in the second concave portion, the third through hole is located outside the second concave portion, the second concave portion is provided with a second step, the second step is provided with an air valve seat, the first one-way valve is arranged on the air valve seat, the air valve seat is provided with a fixing ring, and there is interference fit between the fixing ring and the second concave portion.

7. The container cover of claim 6, wherein, the second top wall is also provided with a third concave portion, the third concave portion is adjacent to the second concave portion, the third concave portion is provided with a third annular convex, and the third through hole is located in an area surrounded by the third annular convex.

8. The container cover of claim 1, wherein, a reset spring is arranged in the air extraction cavity, one end of the reset spring is attached to the first top wall, and the other end of the reset spring is attached to the inner cover.

9. The container cover of claim 1, wherein, the cover body is further provided with a fourth through hole, the fourth through hole is located outside the air extraction assembly, and the fourth through hole is provided with a sealing plug.

10. A vacuum preservation container, comprising a body and a container cover arranged at an open end of the body, wherein, the container cover comprises a cover body, a first through hole is provided at an upper surface of the cover body, the first through hole is provided with air extraction assembly, the air extraction assembly comprises an outer cover and an inner cover, the inner cover is arranged on an upper end of the first through hole in a sealing manner, a second through hole and a third through hole are provided at an upper surface of the inner cover, the second through hole is in communication with a first through hole, the second through hole is provided with a first one-way valve, and the third through hole is provided with a second one-way valve;

the outer cover is made of elastic material and has a dome-shaped first top wall, the outer cover is arranged at an upper end of the inner cover in a sealing manner, an air extraction cavity is enclosed between the outer cover and the inner cover, the first top wall constitutes a top wall of the air extraction cavity, the first through hole and the second through hole are located at a bottom of the air extraction cavity, an air flow direction of the first one-way valve is from inside of the body to inside of the air extraction cavity, and an air flow direction of the second one-way valve is from inside of the air extraction cavity to outside of the air extraction cavity.

11. The vacuum preservation container of claim 10, wherein, the outer cover has an annular first side wall, the first side wall is located on an outer edge of the first top wall, the inner cover comprises a circular second top wall and a annular second side wall, the second through hole and the third through hole are both located on the second top wall, and the second side wall is located on an outer edge of the second top wall; the outer cover is arranged on the inner cover, and there is interference fit between the first side wall and the second side wall.

12. The vacuum preservation container of claim 11, wherein, a first step is provided at an inner circumference wall of the outer cover at a joint of the first top wall and the first side wall, and the outer edge of the second top wall is attached to the first step.

13. The vacuum preservation container of claim 12, wherein, a first concave portion is provided at the upper surface of the cover body, the first through hole is located inside the first concave portion, a first annular convex is arranged outside the first through hole, a lower surface of the second top wall is attached to the first annular convex, the first through hole and the second through hole are both located inside an axial extension area of the first annular convex, and the third through hole is located outside the axial extension area of the first annular convex.

14. The vacuum preservation container of claim 13, wherein, the first concave portion is also provided with a second annular convex, the first annular convex is located in an area surrounded by the second annular convex, the third through hole is located between the first annular convex and the second annular convex, the second annular convex is provided with a first notch, a annular mounting groove is formed between the second annular convex and a circumferential wall of the first concave portion, the first side wall and the second side wall are located within the mounting groove, the first side wall is provided with a second notch, and the first notch and second notch are in communication with each other.

15. The vacuum preservation container of claim 14, wherein, the second top wall is provided with a second concave portion, the second through hole is located in the second concave portion, the third through hole is located outside the second concave portion, the second concave portion is provided with a second step, the second step is provided with an air valve seat, the first one-way valve is arranged on the air valve seat, the air valve seat is provided with a fixing ring, and there is interference fit between the fixing ring and the second concave portion.

16. The vacuum preservation container of claim 15, wherein, the second top wall is also provided with a third concave portion, the third concave portion is adjacent to the second concave portion, the third concave portion is provided with a third annular convex, and the third through hole is located in an area surrounded by the third annular convex.

17. The vacuum preservation container of claim 10, wherein, a reset spring is arranged in the air extraction cavity, one end of the reset spring is attached to the first top wall, and the other end of the reset spring is attached to the inner cover.

18. The vacuum preservation container of claim 10, wherein, the cover body is further provided with a fourth through hole, the fourth through hole is located outside the air extraction assembly, and the fourth through hole is provided with a sealing plug.

19. The vacuum preservation container of claim 11, wherein, the cover body is further provided with a fourth through hole, the fourth through hole is located outside the air extraction assembly, and the fourth through hole is provided with a sealing plug.

20. The vacuum preservation container of claim 12, wherein, the cover body is further provided with a fourth through hole, the fourth through hole is located outside the air extraction assembly, and the fourth through hole is provided with a sealing plug.

* * * * *